US009187840B2

(12) United States Patent
Wada et al.

(10) Patent No.: US 9,187,840 B2
(45) Date of Patent: Nov. 17, 2015

(54) METHOD FOR FORMATION OF ANODE OXIDE FILM

(75) Inventors: Koji Wada, Kobe (JP); Mamoru Hosokawa, Kobe (JP); Takayuki Tsubota, Kobe (JP); Jun Hisamoto, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 465 days.

(21) Appl. No.: 13/581,086

(22) PCT Filed: Feb. 23, 2011

(86) PCT No.: PCT/JP2011/054036

§ 371 (c)(1),
(2), (4) Date: Aug. 24, 2012

(87) PCT Pub. No.: WO2011/105452

PCT Pub. Date: Sep. 1, 2011

(65) Prior Publication Data

US 2012/0318674 A1 Dec. 20, 2012

(30) Foreign Application Priority Data

Feb. 24, 2010 (JP) ..... 2010-039126
Jan. 6, 2011 (JP) ..... 2011-001323

(51) Int. Cl.
*C25D 11/04* (2006.01)
*C25D 11/18* (2006.01)
(Continued)

(52) U.S. Cl.
CPC ..... *C25D 11/04* (2013.01); *C25D 11/024* (2013.01); *C25D 11/08* (2013.01); *C25D 11/16* (2013.01); *C25D 11/18* (2013.01); *C25D 11/246* (2013.01); *C25D 21/12* (2013.01)

(58) Field of Classification Search
CPC ..... C25D 11/02–11/34; C25D 21/12
See application file for complete search history.

(56) References Cited

U.S. PATENT DOCUMENTS 4,517,059 A * 5/1985 Loch et al. ..... 205/83
6,126,808 A 10/2000 Rasmussen
(Continued)

FOREIGN PATENT DOCUMENTS

JP 4 119617 4/1992
JP 7 216588 8/1995
(Continued)

OTHER PUBLICATIONS

International Search Report Issued Jun. 7, 2011 in PCT/JP11/54036 Filed Feb. 23, 2011.
(Continued)

*Primary Examiner* — James Lin
*Assistant Examiner* — Ho-Sung Chung
(74) *Attorney, Agent, or Firm* — Oblon, McClelland, Maier & Neustadt, L.L.P.

(57) ABSTRACT

The present invention provides a method for forming an anode oxide film, in which on the assumption that a direct-current power source is used, a thick anode oxide film can be formed with good productivity within a short time without using special equipment. The method includes allowing a current $A_0$ to pass through an aluminum base material, and includes a step of repeating a first electricity cut-off treatment multiple times, in which when a voltage reaches a voltage V1 during the formation of the film, the passage of electricity is once cut off, this electricity cut-off is continued for a period equal to or longer than an electricity cut-off time T1, and the passage of electricity is then resumed, wherein the voltage V1 and electricity cut-off time T1 satisfy the prescribed expressions.

10 Claims, 11 Drawing Sheets

(51) Int. Cl.

| | |
|---|---|
| ***C25D 11/02*** | (2006.01) |
| ***C25D 11/08*** | (2006.01) |
| ***C25D 11/16*** | (2006.01) |
| ***C25D 11/24*** | (2006.01) |
| *C25D 21/12* | (2006.01) |

(56) References Cited

U.S. PATENT DOCUMENTS

| | | | | |
|---|---|---|---|---|
| 6,254,759 | B1 | 7/2001 | Rasmussen | |
| 2002/0008035 | A1 | 1/2002 | Rasmussen | |
| 2003/0035970 | A1* | 2/2003 | Wada et al. | 428/472.2 |
| 2003/0141193 | A1 | 7/2003 | Hossick-Schott | |
| 2004/0016645 | A1 | 1/2004 | Rasmussen | |
| 2004/0229078 | A1 | 11/2004 | Maeda | |
| 2006/0049059 | A1* | 3/2006 | Chao et al. | 205/323 |
| 2006/0113193 | A1 | 6/2006 | Rasmussen | |
| 2006/0180474 | A1* | 8/2006 | Fujimoto et al. | 205/213 |
| 2009/0159450 | A1 | 6/2009 | Rasmussen | |
| 2011/0174627 | A1 | 7/2011 | Wada et al. | |

FOREIGN PATENT DOCUMENTS

| | | |
|---|---|---|
| JP | 11 236696 | 8/1999 |
| JP | 11 315396 | 11/1999 |
| JP | 2004 332081 | 11/2004 |
| JP | 2005 516121 | 6/2005 |
| JP | 2006 336050 | 12/2006 |
| JP | 2006 336081 | 12/2006 |
| JP | 2008 291302 | 12/2008 |

OTHER PUBLICATIONS

Written Opinion Issued Jun. 7, 2011 in PCT/JP11/54036 Filed Feb. 23, 2011 (partial English translation only).

* cited by examiner

AA: ELECTRICITY CUT-OFF OF 200 SECONDS (No.7)

BB: ELECTRICITY CUT-OFF OF 100 SECONDS (No.6)

CC: ELECTRICITY CUT-OFF OF 50 SECONDS (No.5)

DD: ELECTRICITY CUT-OFF OF 25 SECONDS (No.4)

AA': ELECTRICITY CUT-OFF OF 200 SECONDS : $y = 145-26.0\ln(x)$

BB': ELECTRICITY CUT-OFF OF 100 SECONDS : $y = 137-25.6\ln(x)$

CC': ELECTRICITY CUT-OFF OF 50 SECONDS : $y = 132-25.3\ln(x)$

DD': ELECTRICITY CUT-OFF OF 25 SECONDS

AA": ELECTRICITY CUT-OFF OF 200 SECONDS

BB": ELECTRICITY CUT-OFF OF 100 SECONDS

CC": ELECTRICITY CUT-OFF OF 50 SECONDS

DD": ELECTRICITY CUT-OFF OF 25 SECONDS

XX: ELECTRICITY CUT-OFF OF 200 SECONDS

YY: ELECTRICITY CUT-OFF OF 50 SECONDS

ZZ: ELECTRICITY CUT-OFF OF 50 SECONDS
(INCLUDING ELECTRICITY CUT-OFF OF 200 SECONDS)

YY: ELECTRICITY CUT-OFF OF 50 SECONDS

ZZ: ELECTRICITY CUT-OFF OF 50 SECONDS (INCLUDING ELECTRICITY CUT-OFF OF 200 SECONDS)

XX: ELECTRICITY CUT-OFF OF 200 SECONDS

YY: ELECTRICITY CUT-OFF OF 50 SECONDS

ZZ: ELECTRICITY CUT-OFF OF 50 SECONDS
(INCLUDING ELECTRICITY CUT-OFF OF 200 SECONDS)

YY: ELECTRICITY CUT-OFF OF 50 SECONDS

ZZ: ELECTRICITY CUT-OFF OF 50 SECONDS
(INCLUDING ELECTRICITY CUT-OFF OF 200 SECONDS)

XX: ELECTRICITY CUT-OFF OF 200 SECONDS

YY: ELECTRICITY CUT-OFF OF 50 SECONDS

ZZ: ELECTRICITY CUT-OFF OF 50 SECONDS
(INCLUDING ELECTRICITY CUT-OFF OF 200 SECONDS)

YY: ELECTRICITY CUT-OFF OF 50 SECONDS

ZZ: ELECTRICITY CUT-OFF OF 50 SECONDS
(INCLUDING ELECTRICITY CUT-OFF OF 200 SECONDS)

METHOD FOR FORMATION OF ANODE OXIDE FILM

TECHNICAL FIELD

The present invention relates to a method for forming an anode oxide film on a surface of an aluminum base material such as aluminum or an aluminum alloy. In particular, the present invention relates to a method in which an anode oxide film which is thicker than the conventional films can be formed simply and with good productivity.

BACKGROUND ART

An anode oxidation treatment in which an anode oxide film is formed on a surface of a member composed of aluminum or an aluminum alloy as a base material (aluminum base material), thereby imparting plasma resistance, corrosion gas resistance, and the like to the base material has hitherto been widely adopted.

For example, vacuum chambers used for a plasma treatment apparatus of semiconductor manufacturing equipment, and various members to be provided in the inside of the vacuum chamber, such as electrodes, are usually formed using an aluminum alloy. However, when the aluminum alloy is used in a pure state, plasma resistance, corrosion gas resistance, and the like cannot be kept, and therefore, a treatment for imparting plasma resistance, corrosion gas resistance, and the like has been taken by applying an anode oxidation treatment on the surface of the member formed of the aluminum alloy to form an anode oxide film thereon.

Though the anode oxide film is formed with a different thickness according to an application thereof, in order to carry out the anode oxidation treatment, a direct-current power source is frequently used. In the case where the anode oxidation treatment is conducted with a constant current, the voltage increases with an increase of the thickness to produce a high voltage, and the aluminum base material is dissolved, and therefore, an anode oxidation-treated aluminum base material having a good thickness cannot be obtained. Though a relation between the thickness and the voltage and a voltage at which the aluminum base material is dissolved vary depending upon the treatment condition, the limit of the thickness is in general about 100 μm.

Then, in order that the aluminum base material may not be dissolved, a treatment with a constant voltage within a voltage range where the aluminum base material is not dissolved is effective, and for example, there is a method in which the treatment is started by means of a constant current treatment, and when the voltage reaches the "upper limit voltage" that is lower than a voltage at which the aluminum base material is dissolved, the treatment is switched to a constant voltage treatment with that "upper limit voltage". However, when the treatment is switched to the constant voltage treatment by such a method, the current density is largely lowered, and the thickness is proportional to an accumulated quantity of electricity ((current density)×(treatment time)), namely a film formation rate ((thickness)/(time)) is proportional to the current density, and therefore, another problem that it takes a long time for the treatment, leading to deterioration of the productivity is caused.

In the light of the above, as a method for suppressing poor appearance or forming a thick film with a high speed, there are disclosed a method for forming an anode oxide film by applying an electrolyte to an article to be treated from a large number of electrolyte injection nozzles in an electrolyte bath; and the like (for example, Patent Documents 1 to 3). However, these technologies lead to an increase in costs by equipment investment, e.g. necessity of equipment for injection, etc.

Members on which an anode oxide film is formed may be required to have high hardness according to an application thereof, as seen in the foregoing semiconductor manufacturing apparatus equipment. However, it is the actual situation that techniques which have been proposed up to date cannot sufficiently treat those problems.

As a method for allowing an anode oxide film to have high hardness, for example, Patent Document 4 proposes a method for forming a high hardness anode oxide film using a sulfuric acid based electrolyte having an alcohol added thereto. However, this method involves such a problem that the control of a concentration change of the alcohol in the electrolyte by the anode oxidation treatment is complicated.

In addition, Patent Document 5 proposes a method for further forming an oxide sprayed film on a surface of a surface-treated member in which anode oxidation processing is applied to an aluminum alloy base material and discloses that the obtained film has high hardness. However, this method involves such problems that the treatment for forming the oxide sprayed film is very complicated; expensive equipment is required; and this method cannot be applied to a part of a complicated shape.

On the other hand, in an application as in semiconductor manufacturing equipment, from the viewpoint of suppressing a chemical reaction between the gas and the anode oxide film, there may be the case where a hydration treatment (commonly called sealing treatment) is applied to the anode oxide film. However, it is also known that in the case where the hydration treatment is conducted, the hardness of the anode oxide film is rather lowered (for example, Patent Document 6).

PRIOR ART DOCUMENTS

Patent Documents

Patent Document 1: JP-A-11-236696
Patent Document 2: JP-A-2006-336050
Patent Document 3: JP-A-2008-291302
Patent Document 4: JP-A-2006-336081
Patent Document 5: JP-A-2004-332081
Patent Document 6: JP-A-7-216588

SUMMARY OF THE INVENTION

Problems that the Invention is to Solve

Under such circumstances, the present invention has been made, and an object thereof is to provide a method for forming an anode oxide film, in which on the assumption that a direct-current power source is used, a thick anode oxide film can be formed with good productivity within a short time without using special equipment, and if desired, it is also possible to contrive to realize high hardness of the film.

Means for Solving the Problems

The present invention encompasses the following embodiments.

[1] A method for forming an anode oxide film, comprising allowing a prescribed current $A_o$ to pass through an aluminum base material selected from aluminum and an aluminum alloy, the method comprising a step of repeating a first electricity cut-off treatment multiple times, in which when a voltage reaches a prescribed voltage V1 during the formation of the film, the passage of electricity is once cut off, this electricity cut-off is continued for a period equal to or longer than an electricity cut-off time T1, and the passage of electricity is then resumed, wherein the prescribed voltage V1 satisfies the following expression (1a); and the electricity cut-off time T1 satisfies the following expression (1b):

$$V1<V_{min} \quad (1a)$$

$$T1_{im}\leq T1 \quad (1b)$$

wherein $V_{min}$ represents a minimum value of a voltage at which when an anode oxidation treatment is conducted with a prescribed current $A_o$ without conducting an electricity cut-off treatment, the aluminum base material starts to be dissolved; and $T1_{im}$ represents a minimum value of an electricity cut-off time necessary for a voltage at the time of resuming the passage of electricity to become lower than V1.

[2] The method for forming an anode oxide film according to [1], wherein the prescribed voltage V1 satisfies the following expression (2a); and the electricity cut-off time T1 satisfies the following expression (2b):

$$0.5\times V_{min}<V1<V_{min} \quad (2a)$$

$$T_{min}\leq T1\leq 1.2\times T_{min} \quad (2b)$$

wherein $V_{min}$ is the same as defined above; and $T_{min}$ represents a minimum value of an electricity cut-off time necessary for achieving a target thickness D1 of the anode oxide film.

[3] The method for forming an anode oxide film according to [2], wherein the target thickness D1 is 100 μm or more, and the $V_{min}$ is from 100 to 150 V.

[4] The method for forming an anode oxide film according to [3], wherein the expression=100 to 150 V is achieved by using a 6000 series aluminum alloy as the aluminum base material and using sulfuric acid as an anode oxidation treatment liquid.

[5] The method for forming an anode oxide film according to any one of [1] to [4], wherein a second electricity cut-off treatment in which an electricity cut-off time is longer than the T1 is carried out.

[6] The method for forming an anode oxide film according to [5], wherein an electricity cut-off time T2 of the second electricity cut-off treatment is at least 1.5 times and not more than 5 times the T1.

[7] The method for forming an anode oxide film according to [5] or [6], wherein the second electricity cut-off treatment is conducted after the first electricity cut-off treatment at the n-th time which satisfies the following expression (3):

$$0.5\leq T_{min(n-1)}/T_{int(1)}\leq 0.9 \quad (3)$$

wherein $T_{int(1)}$ represents a time of from the completion of the first electricity cut-off treatment at the first time to the start of the first electricity cut-off treatment at the second time; and $T_{min(n-1)}$ represents a time of from the completion of the first electricity cut-off treatment at the (n−1)-th time to the start of the first electricity cut-off treatment at the n-th time.

[8] The method for forming an anode oxide film according to any one of [5] to [7], wherein the second electricity cut-off treatment is carried out multiple times.

[9] The method for forming an anode oxide film according to any one of [1] to [8], wherein the V1 is from 60 to 115 V.

[10] A method comprising a step in which, after the formation of an anode oxide film by the method according to any one of [1] to [9], a hydration treatment of dipping the anode oxide film in pure water at from 80 to 100° C. under the condition satisfying the following relation is carried out:

$$\text{treatment time(min)}\geq -1.5\times[\text{treatment temperature(° C.)}]+270.$$

[11] A method comprising a step in which, after the hydration treatment by the method according to [10], a heat treatment of heating the anode oxide film under the condition satisfying the following relations is carried out:

$$\text{treatment temperature}=120 \text{ to } 450° \text{ C.; and}$$

$$\text{treatment time(min)}\geq -0.1\times[\text{treatment temperature(° C.)}]+71.$$

[12] The method for forming an anode oxide film according to any one of [1] to [11], wherein before the anode oxide film is formed, the aluminum base material is subjected to a hydration treatment in pure water.

The voltage V1 is only necessary to be set to a voltage lower than the minimum value of the voltage ($V_{min}$) at which when the anode oxidation treatment is conducted with a prescribed current $A_0$ without conducting an electricity cut-off treatment, the aluminum base material starts to be dissolved. Although the $V_{min}$ depends on the aluminum base material, the voltage V1 is generally suitably 60 to 115V as described above [9].

In addition, the anode oxide film can be hardened by subjecting to the treatment described above [10].

In addition, the anode oxide film can be further hardened by subjecting to the treatment described above [11].

In addition, the anode oxide film can be further hardened by subjecting to the treatment described above [12].

Advantage of the Invention

According to the present invention, when an anode oxide film is formed by allowing a prescribed current to pass through an aluminum base material selected from aluminum and aluminum alloys, by adopting a constitution of repeating a first electricity cut-off treatment multiple times, in which when the voltage reaches a prescribed voltage during the formation of the film, the passage of electricity is once cut off, this electricity cut-off is continued for a period equal to or longer than an electricity cut-off time T1, and the passage of electricity is then resumed, a thick anode oxide film can be formed with good productivity within a short time without using special equipment. Members having the anode oxide film formed on the base material in this way are useful as a material of vacuum chambers used for plasma treatment apparatus of semiconductor manufacturing equipment, and the like.

EMBODIMENTS FOR CARRYING OUT THE INVENTION

In the case where the anode oxidation treatment is conducted with a constant current, since the film formation rate is proportional to the current, the film formation rate is large. However, the voltage increases with an increase of the thickness, and the aluminum base material is dissolved at a high voltage, which causes poor appearance. On the other hand, in the case where the treatment is conducted with a constant voltage, the aluminum base material is not dissolved by conducting the treatment at a voltage lower than the voltage at which the aluminum base material is dissolved. However, the current decreases with an increase of the thickness, whereby the treatment time becomes long.

From the viewpoint of avoiding the foregoing inconvenience to be caused in the case of the treatment with a constant current, the present inventors made investigations from various angles. As a result, it has been found that, when an anode oxide film is formed by allowing a prescribed current $A_0$ to pass through an aluminum base material selected from aluminum and aluminum alloys, by adopting a constitution of repeating a first electricity cut-off treatment multiple times, in which when the voltage reaches a prescribed voltage V1 during the formation of the film, the passage of electricity is once cut off (hereinafter referred to as "electricity cut-off"), this electricity cut-off is continued for a period equal to or longer than an electricity cut-off time T1, and the passage of electricity is then resumed; and allowing the prescribed voltage V1 to satisfy the following expression (1a) and allowing the electricity cut-off time T1 to satisfy the following expression (1b), the foregoing object is excellently achieved, leading to accomplishment of the present invention.

$$V1<V_{min} \quad (1a)$$

$$T1_{im}\leq T1 \quad (1b)$$

(In the expressions, $V_{min}$ represents a minimum value of the voltage at which when the anode oxidation treatment is conducted with a prescribed current $A_0$ without conducting the electricity cut-off treatment, the aluminum base material starts to be dissolved; and $T1_{im}$ represents a minimum value of the electricity cut-off time necessary for the voltage at the time of resuming the passage of electricity to become lower than V1.)

Figure 1:
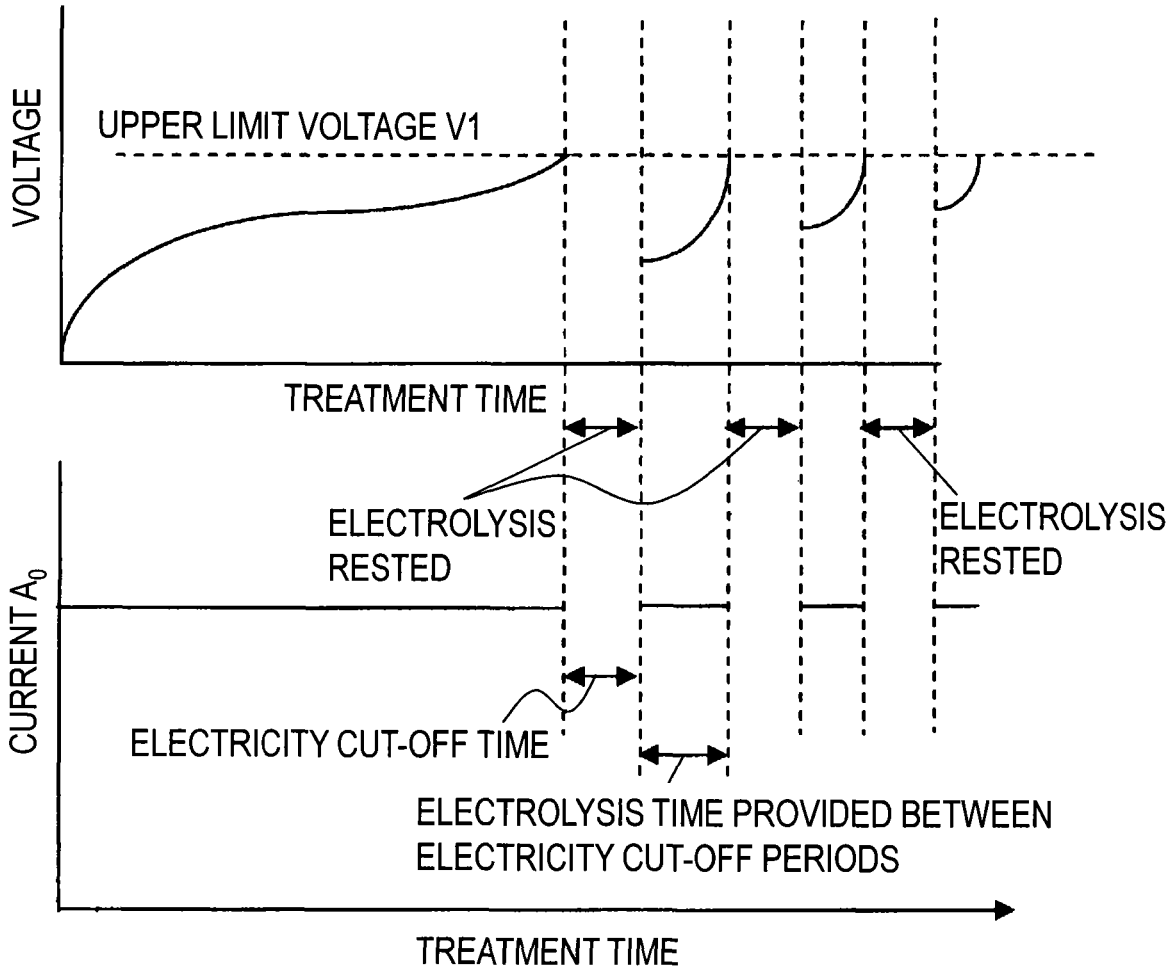
FIG. 1 is an explanatory drawing showing changes with time of voltage and current when the method of the present invention is carried out.

The method of the present invention is described in detail by reference to the drawings. FIG. 1 is an explanatory drawing showing changes with time of voltage and current when the method of the present invention is carried out. According to the method of the present invention, a first electricity cut-off treatment, in which when the voltage reaches a prescribed voltage V1 (also referred to as "upper limit voltage"), electricity cut-off is once conducted, this electricity cut-off is continued for a period equal to or longer than an electricity cut-off time T1, and the passage of electricity is then resumed, is repeated multiple times. The terms "repeated multiple times" as referred to herein mean that the treatment is repeated until the thickness of the anode oxide film reaches at least the desired thickness. As described later, though the number of times of electricity cut-off cannot be unequivocally defined because it varies depending upon the electricity cut-off time or the desired thickness, the number is, for example, from about 50 times to 200 times.

Since the voltage at the time of resuming the passage of electricity after the electricity cut-off (at the time of resumption of electrolysis) is lower than the upper limit voltage before the electricity cut-off, the treatment in a set current density can be intermittently continued, and by setting the upper limit voltage to a voltage lower than the voltage at which the aluminum base material is dissolved [relation of the foregoing expression (1a)], dissolution of the aluminum base material can be deterred. In addition, by setting the electricity cut-off time T1 to a time equal to or longer than the minimum value $T1_{im}$ of the electricity cut-off time necessary for the voltage at the time of resuming the passage of electricity to become lower than V1 [relation of the foregoing expression (1b)] and repeating such a treatment (first electricity cut-off treatment), a thick anode oxide film can be formed with good productivity within a short time.

Though all of the reasons why the foregoing effects are obtained according to the method of the present invention have not been elucidated yet, the following could be probably considered. The voltage during the anode oxidation treatment is constituted of a barrier layer forming voltage and a voltage to be caused due to liquid resistance within a pore. In addition, the increase of the voltage with an increase of the thickness is caused due to an increase of the voltage to be caused due to a liquid composition within a pore. Then, within the pore, a reaction of ($OH^- \rightarrow O_2^- + H^+$) takes place in the treatment liquid in a bottom of the pore, and a reaction of ($Al \rightarrow Al_3^+ + 3e''$) takes places in the aluminum base material, respectively, and $Al_3^+$ and $O_2^-$ are bonded to each other to form $Al_2O_3$.

In consequence, $OH^-$ is consumed with the formation of $Al_2O_3$, and $OH^-$ is hardly supplied from a bulk solution with an increase of the thickness. Therefore, it may be considered that the $OH^-$ concentration within the pore decreases, whereas the voltage increases. By conducting the foregoing electricity cut-off treatment, the liquid within the pore (anode oxidation treatment liquid) is renewed, whereby the increase of the voltage can be suppressed.

In the method of the present invention, parameters regarding the condition of the anode oxidation treatment (electrolysis condition) are the "electricity cut-off time T1" and the "upper limit voltage (voltage V1)"; and the "electrolysis time provided between electricity cut-off periods" is a "time until the voltage reaches the upper limit voltage V1" after the electrolyte is resumed and varies depending upon the "electricity cut-off T1" and the "upper limit voltage" and the like. First of all, the "electricity cut-off T1" is described.

Since the thickness of the anode oxide film is determined by an accumulated quantity of electricity that is the product of a current density and an electrolysis time during the anode oxidation treatment, a total electrolysis time for obtaining a desired thickness is constant regardless of the "electricity cut-off time T1" or "number of times of electricity cut-off".

That is, a total treatment time including the electricity cut-off time T1 is expressed by [(total treatment time)=(total electrolysis time)+(total electricity cut-off time ((electricity cut-off time T1)×(number of times of electricity cut-off)))], and the shorter the electricity cut-off time is, or the smaller the number of times of electricity cut-off is, the shorter the total treatment time is.

However, the shorter the electricity cut-off time T1 is, the smaller the decrease of the voltage after the resumption of electricity cut-off is, and therefore, the electrolysis time provided between electricity cut-off periods becomes short. Thus, the number of times of electricity cut-off becomes rather large. Conversely, the longer the electricity cut-off time T1 is, the smaller the number of times of electricity cut-off is. That is, both the electricity cut-off time and the number of times of electricity cut-off cannot be made small. Under such circumstances, any influence of the electricity cut-off time T1 or the number of times of electricity cut-off on the total electricity cut-off time was investigated. As a result, it has become clear that shortening of the electricity cut-off time T1 is effective for shortening of the total electricity cut-off time.

On the other hand, when the electricity cut-off time T1 is too short, the voltage after the resumption of electricity cut-off does not decrease (namely, the upper limit voltage is kept), and it may be impossible to continue the treatment, and therefore, it is necessary to set the electricity cut-off time T1 appropriately. Also, the electrolysis time provided between electricity cut-off periods becomes short with an increase of the thickness, and therefore, it is necessary to set the electricity cut-off time T1 appropriately such that the electrolysis time provided between electricity cut-off periods does not become zero until a desired thickness thereof is obtained.

In the light of the above, it is necessary to set the foregoing electricity cut-off time T1 to a time equal to or longer than the minimum value $T1_{im}$ of the electricity cut-off time necessary for the voltage at the time of resumption of the passage of electricity to become lower than V1 [the forgoing expression (1b)].

In the method of the present invention, it is preferable to carry out the treatment such that the voltage V1 satisfies the foregoing expression (2a); and that the electricity cut-off time T1 satisfies the foregoing expression (2b). In addition, at that time, D1 (target thickness) is, for example, 100 μm or more, and the foregoing $V_{min}$ is, for example, from about 100 to 150 V.

Specifically, $V_{min}$ becomes 120 V under the condition of using a 6061 alloy as the aluminum base material in sulfuric acid (for example, 150 g/L at 0° C.) as an anode oxidation treatment liquid at a current density of 4.0 A/dm$^2$, and therefore, the formation of an anode oxide film having a thickness of 100 μm or more in the case of setting the upper limit voltage (V1) to 80 V was investigated. As a result, it has been noted that when the set thickness is denoted as x (μm), the electricity cut-off time T1 may be set to a time satisfying a relation of [electricity cut-off time (sec)$\geq 0.31\times e^{(0.0252x)}$ (e is base of natural logarithms)]. That is, the right side [$0.31\times e^{(0.0252x)}$] of the foregoing expression means a minimum value of the electricity cut-off time T1 necessary for achieving the target thickness D1 of the anode oxide film.

In repeating the electricity cut-off treatment (first electricity cut-off treatment) satisfying the foregoing condition, it has become clear that to carry out an electricity cut-off treatment (second electricity cut-off treatment) in which the electricity cut-off time is longer than the foregoing electricity cut-off time T1 is effective in the end for shortening the treatment time. When such a second electricity cut-off treatment is conducted, an electricity cut-off time T2 of the second electricity cut-off treatment is preferably about at least 1.5 times and not more than about 5 times the foregoing electricity cut-off time T1.

When the foregoing second electricity cut-off treatment is carried out, with regard to its timing, it is preferable to conduct the foregoing second electricity cut-off treatment after the first electricity cut-off treatment at the n-th time which satisfies the following expression (3).

$$0.5 \leq T_{min(n-1)}/T_{int(1)} \leq 0.9 \quad (3)$$

(In the expression, $T_{int(1)}$ represents a time of from the completion of the first electricity cut-off treatment at the first time to the start of the first electricity cut-off treatment at the second time; and $T_{min(n-1)}$ represents a time of from the completion of the first electricity cut-off treatment at the (n−1)-th time to the start of the first electricity cut-off treatment at the n-th time.)

The foregoing second electricity cut-off treatment can be carried out multiple times. In the case of carrying out the second electricity cut-off treatment multiple times, the electricity cut-off times T2 in the respective treatments may be different from each other. Though the number of times of electricity cut-off in the second electricity cut-off treatment cannot be unequivocally defined because it varies depending upon the electricity cut-off time or the desired thickness, it may be, for example, a relatively small number of times, e.g. from about 1 to 10 times, and the number of times can be increased to from about 50 to 200 times.

The foregoing upper limit voltage (V1) is set to a voltage lower than the minimum value ($V_{min}$) of the voltage at which when the anode oxidation treatment is conducted with a prescribed current $A_0$ without conducting the electricity cut-off treatment, the aluminum base material starts to be dissolved. Though this voltage V1 varies depending upon the aluminum base material, it is appropriately in the range of from 60 to 115V.

As the aluminum or aluminum alloy which is used as the base material in the present invention, not only pure aluminum (for example, 1000 series aluminum) but commercially available aluminum alloys (for example, a 6061 aluminum alloy and a 5052 aluminum alloy as defined in JIS) can be used. In addition, as the anode oxidation treatment liquid which is used in the present invention, general sulfuric acid solutions, oxalic acid solutions, phosphoric acid solutions and the like and mixed solutions thereof may be used. With regard to the treatment liquid temperature, for example, from the viewpoint of film hardness, when the temperature is low, a high-hardness film is produced. Thus, the treatment liquid temperature may be properly set depending upon the performance required for the film. The current density may be properly set, and when the current density is large, the film formation rate becomes large, and such is advantageous. However, since the voltage is liable to increase, the voltage is easy to reach the upper limit voltage. Therefore, the current density may be set depending upon the desired thickness while taking into consideration a balance thereamong.

The present inventors have also studied a method for contriving to realize a high hardness of the anode oxide film for a long time. As a result, they have found that the high hardness of the film can be realized by applying a hydration treatment or a heat treatment after the anode oxidation treatment, and perceived meanings thereof, and then previously filed an application for patent (Japanese Patent Application No. 2009-169100).

That is, it is effective for realizing a high hardness of the anode oxide film to carry out a hydration treatment of dipping the anode oxide film in pure water at from 80 to 100° C. under the condition satisfying the following relation, after forming an anode oxide film by the foregoing anode oxidation treatment:

treatment time(min)≥−1.5×[treatment temperature(° C.)]+270 or to carry out a heat treatment of heating the anode oxide film under the condition satisfying the following relations, after applying this hydration treatment:

treatment temperature=120 to 450° C.; and treatment time(min)≥−0.1×[treatment temperature(° C.)]+71.

These setting conditions are described.

(Treatment Time of Hydration Treatment)

Even when the treatment temperature of the hydration treatment is specified to the range of from 80° C. to 100° C., if the treatment time is short, the hardness of the anode oxide film conversely decreases. Therefore, it is necessary to specify a minimum treatment time depending upon the treatment temperature. Specifically, the hydration treatment may be carried out so as to satisfy the condition of "treatment time (min)≥−1.5×[treatment temperature (° C.)]+270". Though the reasons why the hardness of the anode oxide film varies depending upon the hydration treatment time are not sufficiently elucidated yet, it may be possibly considered that they are caused due to a balance between a change of the state of the oxide and volume expansion of the oxide in the anode oxide film by the hydration reaction.

When the treatment time of the hydration treatment is set to be long as far as possible within the range satisfying the condition of "treatment time (min)≥−1.5×[treatment temperature (° C.)]+270", the hardness of the anode oxide film becomes high. However, the treatment time may be properly set depending upon the required performance. However, when the treatment time is too long, the productivity is inferior, and therefore, the treatment time of the hydration treatment is preferably 480 minutes or less, and more preferably 300 minutes or less.

(Treatment Temperature of Heat Treatment)

The temperature of the heat treatment is preferably in the range of from 120° C. to 450° C. In the case where the temperature of the heat treatment is lower than 120° C., there is a concern that even when the heat treatment is conducted for the treatment time satisfying the condition of "treatment time (min)≥−0.1×[treatment temperature (° C.)]+71", a high hardness of the anode oxide film is not realized. Though the reasons for this are not sufficiently elucidated yet, it may be considered that they are caused due to the fact that a structural change of the anode oxide film following a dehydration reaction after the hydration reaction is insufficient. On the other hand, when the temperature of the heat treatment exceeds 450° C., there is a possibility that deformation of the aluminum alloy or the like as the base material is liable to take place, and the product falls outside a dimensional tolerance. In consequence, the temperature of the heat treatment is set to the range of from 120° C. to 450° C.

(Treatment Time of Heat Treatment)

Even when the treatment temperature of the heat treatment is specified to the range of from 120° C. to 450° C., if the treatment time is short, the hardness of the anode oxide film is increased only by about Hv 20 or less in terms of a Vickers hardness, and an industrial meaning for applying the heat treatment is not substantially found. Therefore, it is preferable to specify a minimum treatment time depending upon the treatment temperature. Specifically, the heat treatment may be carried out so as to satisfy the condition of "treatment time (min)≥−0.1×[treatment temperature (° C.)]+71". Though the reasons why the hardness of the anode oxide film varies depending upon the heat treatment time are not sufficiently elucidated yet, it may be possibly considered that they are caused due to a structural change of the anode oxide film following a dehydration reaction after the hydration reaction.

When the treatment time of the heat treatment is set to be long as far as possible within the range satisfying the condition of "treatment time (min)≥−0.1×[treatment temperature (° C.)]+71", the hardness of the anode oxide film becomes high. However, the treatment time may be properly set depending upon the required performance. However, when the treatment time is too long, the productivity is inferior, and therefore, the treatment time of the heat treatment is preferably 120 minutes or less, and more preferably 90 minutes or less.

In addition, in contriving to realize a high hardness of the anode oxide film, it is also preferable to subject the aluminum base material to a hydration treatment in pure water before forming an anode oxide film. So far as the base material is subjected to such a treatment, the treatment voltage at the initial stage of the anode oxidation treatment can be increased due to an influence of a hydrated film formed on the surface of the base material, and it is possible to contrive to realize a high hardness of the anode oxide film. Though such a hydration treatment is conducted in pure water (similar in the foregoing hydration treatment), the "pure water" as used at that time is one in which impurities in water are reduced as far as possible such that the impurities are not incorporated into the anode oxide film (for example, a conductivity thereof is less than 1.0 μS/cm).

As for the condition under which the base material is subjected to the hydration treatment, it is preferable to apply a dipping treatment in pure water at from 65 to 100° C. for from about 0.1 to 10 minutes. When the treatment time is short, there is a concern that a sufficient hydrated film cannot be formed on the surface of the base material, and therefore, the treatment time may be set to 0.1 minutes (6 seconds) or longer. However, when the dipping time is too long, there is a concern that the hydrated film becomes conversely too thick, and a long time is required for the anode oxidation treatment. Thus, the treatment time may be set to up to about 10 minutes.

The present invention is hereunder more specifically described by reference to the following Examples. However, the following Examples should not be construed as limiting the scope of the present invention. The present invention can be carried out with appropriate modifications within a scope not departing from the gist described above or later, any of which is included in the technical scope of the present invention.

EXAMPLES

Example 1

A 6061 aluminum alloy as defined in JIS was melted to produce an aluminum alloy ingot (size: 220 mm W×250 mm L×t 100 mm, cooling rate: 15 to 10° C.). The ingot was cut and subjected to face machining (size: 220 mm W×150 mm L×t 60 mm), followed by a soaking treatment (540° C.×8 hours). After the soaking treatment, the material having a thickness of 60 mm was forged into a plate material having a thickness of 20 mm by means of hot forging. Thereafter, the plate material was subjected to a solution heat treatment (540° C.×1 hour), water hardening, and an aging treatment (160 to 180° C.×8 hours), thereby obtaining a test alloy plate. The test alloy plate was cut out into a test piece of 25 mm×35 mm×t 10 mm, a surface of which was then subjected to face machining processing.

Subsequently, the test piece was dipped in a 10% NaOH aqueous solution at 60° C. for 2 minutes and then washed with water. Furthermore, the resulting test piece was dipped in a 20% $HNO_3$ aqueous solution at 30° C. for 2 minutes and then washed with water to clean up the surface, followed by conducting an anode oxidation treatment.

The anode oxidation treatment was conducted under the condition shown in each of the following Tables 1 and 2. In addition, a target thickness D1 of the anode oxide film was set to 200 μm.

TABLE 1

| Test No. | Anode oxidation treatment liquid | Treatment temperature (° C.) | Current density (A/dm$^2$) | Upper limit voltage V1 (V) | Time for reaching the upper limit voltage (sec) | Thickness for reaching the upper limit voltage (μm) | Electricity cut-off time T1 (sec) |
|---|---|---|---|---|---|---|---|
| 1 | 150 g/L of sulfuric acid | 0 | 4 | 80 | 3366 | 85 | Nil* |
| 2 | | | 4 | 80 | 3366 | 85 | 1 |
| 3 | | | 4 | 80 | 3366 | 85 | 3 |
| 4 | | | 4 | 80 | 3366 | 85 | 25 |
| 5 | | | 4 | 80 | 3366 | 85 | 50 |
| 6 | | | 4 | 80 | 3366 | 85 | 100 |
| 7 | | | 4 | 80 | 3366 | 85 | 200 |

| Test No. | Number of times of electricity cut-off (time) | Total electricity cut-off time (sec) | Total electrolysis time after electricity cut-off at the first time (sec) | Thickness (μm) | Total treatment time (sec) | Total treatment time (min) |
|---|---|---|---|---|---|---|
| 1 | — | — | — | 200 | 52250 | 871 |
| 2 | 1 | 1 | 0 | 85 | 3367 | 56 |
| 3 | 3 | 9 | 36 | 86 | 3411 | 193 |
| 4 | 172 | 4300 | 4270 | 193 | 11936 | 193 |
| 5 | 168 | 8400 | 4554 | 200 | 16320 | 272 |
| 6 | 112 | 11200 | 4554 | 200 | 19120 | 319 |
| 7 | 84 | 16800 | 4554 | 200 | 24720 | 412 |

*After the voltage reached 80 V, the constant voltage treatment was conducted at 80 V.

TABLE 2

| Test No. | Current density (A/dm$^2$) | Upper limit voltage V1 (V) | Time for reaching the upper limit voltage (sec) | Thickness for reaching the upper limit voltage (μm) | Electricity cut-off time T1 (sec) | Number of times of electricity cut-off at the time of conducting electricity cut-off of 200 seconds (time) |
|---|---|---|---|---|---|---|
| 5 | 4 | 80 | 3366 | 85 | 50 | — |
| 8 | 4 | 80 | 3366 | 85 | 50 | At 70th time |
| 9 | 4 | 80 | 3366 | 85 | 50 | At 100th time |
| 10 | 4 | 80 | 3366 | 85 | 50 | At 70th time and 90th time |

| Test No. | Number of times of electricity cut-off of 50 seconds (time) | Number of times of electricity cut-off of 200 seconds (time) | Total electricity cut-off time (sec) | Total electrolysis time after electricity cut-off at the first time (sec) | Thickness (μm) | Total treatment time (sec) | Total treatment time (min) |
|---|---|---|---|---|---|---|---|
| 5 | 168 | 0 | 8400 | 4554 | 200 | 16320 | 272 |
| 8 | 154 | 1 | 7900 | 4554 | 200 | 15820 | 264 |
| 9 | 129 | 1 | 6650 | 4554 | 200 | 14570 | 243 |
| 10 | 119 | 2 | 6350 | 4554 | 200 | 14270 | 238 |

First of all, the results shown in Table 1 are considered. Test No. 1 is concerned with an example in which an anode oxide film was formed under the conventional treatment condition. In this Test No. 1, after the voltage reached the upper limit voltage of 80 V by a constant current treatment of 4.0 A/dm$^2$, the treatment was switched to a constant voltage treatment of 80 V, and it took about 871 minutes (total treatment time) for forming the anode oxide film having a thickness of 200 μm.

Test Nos. 2 to 4 are each concerned with an example in which the electricity cut-off time T1 was shortened. Of these, Test No. 2 is concerned with an example in which the electricity cut-off treatment was conducted one time while setting the electricity cut-off time T1 to 1 second; however, the voltage at the time of resuming the electrolysis after the electricity cut-off treatment did not sufficiently decrease, and the electrolysis could not be conducted after the electricity cut-off. Test No. 3 is concerned with an example in which the electricity cut-off treatment was conducted three times while setting the electricity cut-off time T1 to 3 seconds; however, similar to Test No. 2, the voltage at the time of resuming the electrolysis after the electricity cut-off treatment did not sufficiently decrease, and the electrolysis could not be conducted after the electricity cut-off. Test No. 4 is concerned with an example in which the electricity cut-off treatment was conducted 172 times while setting the electricity cut-off time T1 to 25 seconds; however, the voltage at the time of resuming the electrolysis after the electricity cut-off treatment did not still sufficiently decrease, and the electrolysis could not be conducted after the electricity cut-off. In all of these examples, an anode oxide film having a thickness of 200 μm was not formed.

In Test Nos. 5 to 7, by setting the electricity cut-off time T1 to from 50 to 200 seconds, the voltage at the time of resuming the electrolysis after the electricity cut-off treatment sufficiently decreased, the electrolysis effectively proceeded after the electricity cut-off, and an anode oxide film having a thickness of 200 μm was formed at the stage in which the total treatment time was shorter than that of the conventional example (Test No. 1). In these Test Nos. 5 to 7, it is found that the shorter the electricity cut-off time T1 is (Test No. 5<Test No. 6<Test No. 7), the shorter the total treatment time is.

Figure 2:
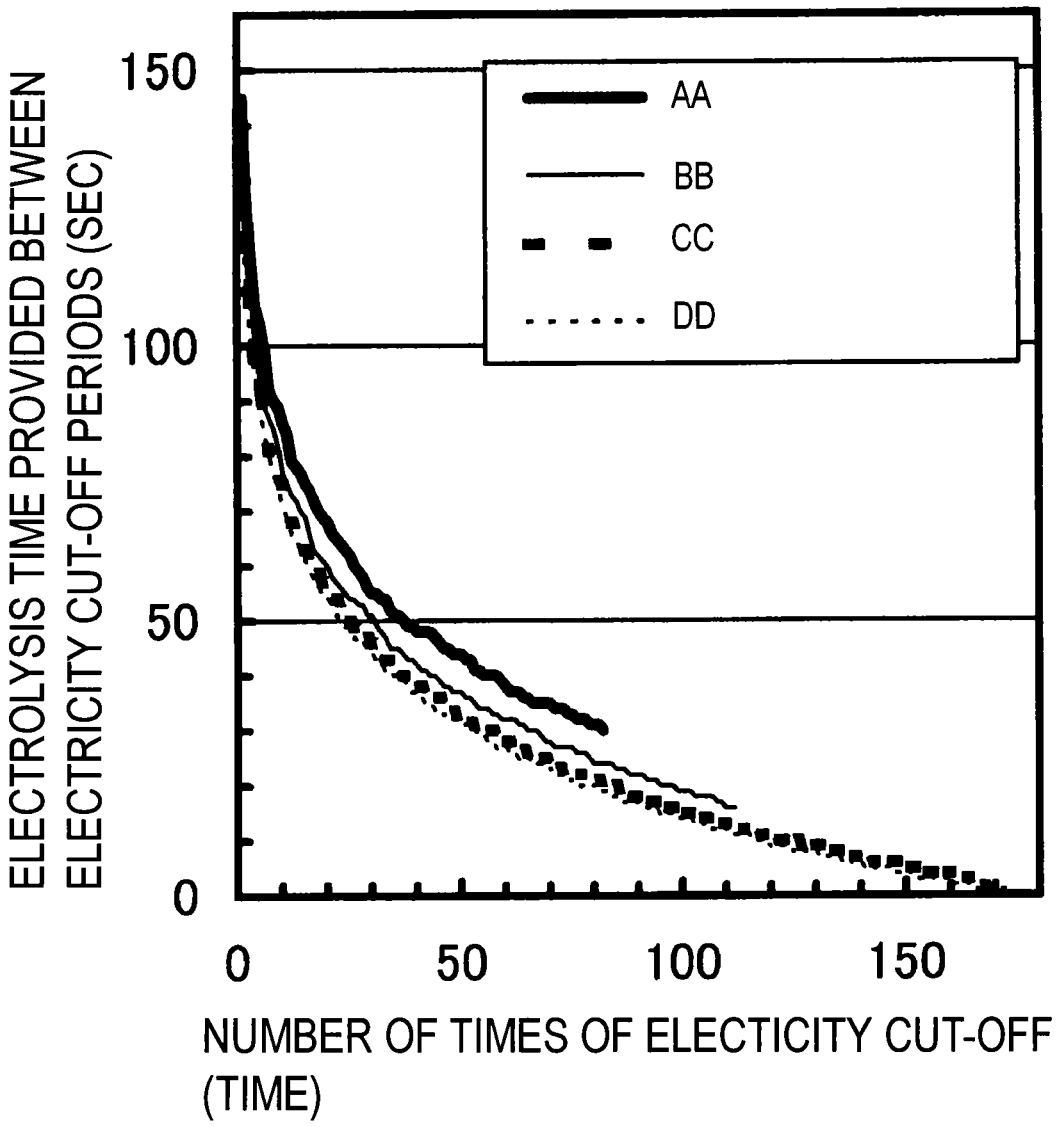
FIG. 2 is a graph showing a relation between "number of times of electricity cut-off" and "electrolysis time provided between electricity cut-off periods" regarding Test Nos. 4 to 7.

FIG. 2 shows a relation between "number of times of electricity cut-off" and "electrolysis time provided between electricity cut-off periods" regarding Test Nos. 4 to 7. The results shown in Figures shown after FIG. 2 (FIGS. 3 to 11) include data on the way of the electricity cut-off treatment in addition to the data shown in the table.

With an increase of the number of times of electricity cut-off (namely, with an increase of the thickness), the electrolysis time provided between electricity cut-off periods becomes short. In Test No. 4 in which the electricity cut-off time was 25 seconds, the voltage did not decrease at the time of resuming the electrolysis at the 173th time of electricity cut-off, and the electrolytic could not be conducted any more. At that time, the thickness was 193 μm and did not reach 200 μm.

Figure 3:
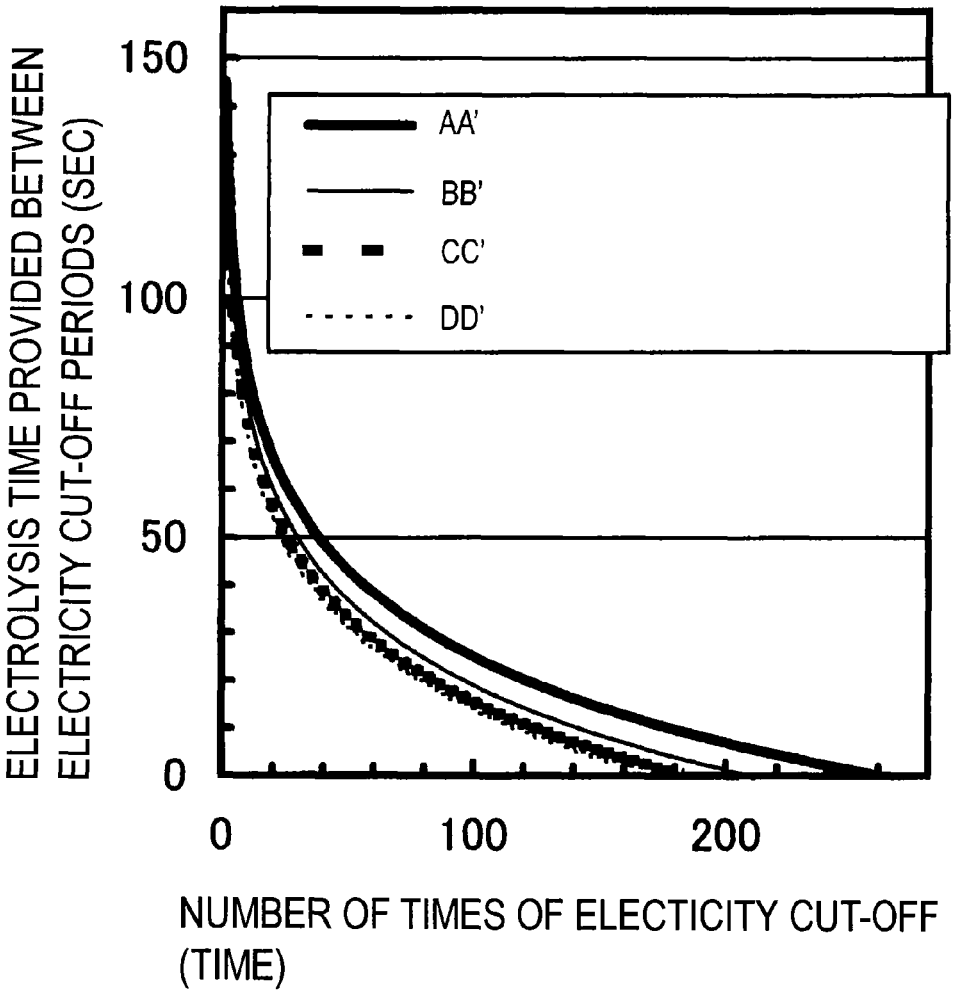
FIG. 3 is a graph expressing the results of FIG. 2 by approximation curves.

FIG. 3 is a graph expressing the results of FIG. 2 by approximation curves. From this FIG. 3, the number of times of electricity cut-off at which the "electrolysis time provided between electricity cut-off periods" at each electricity cut-off time becomes zero was determined. Each of the approximation expressions shown in FIG. 3 is expressed by [y=A−B·ln (x)] On is natural logarithm) when the electrolysis time provided between electricity cut-off periods is denoted as y, and the number of times of electricity cut-off is denoted as x, and each of the constants A and B is set so as to become a measured value of the "electrolysis time provided between electricity cut-off periods" in FIG. 2. In addition, as for the example in which the electricity cut-off time is 25 seconds (Test No. 4), since the "electrolysis time provided between electricity cut-off periods" becomes zero at the 173th time, the measured values are used without any change.

Figure 4:
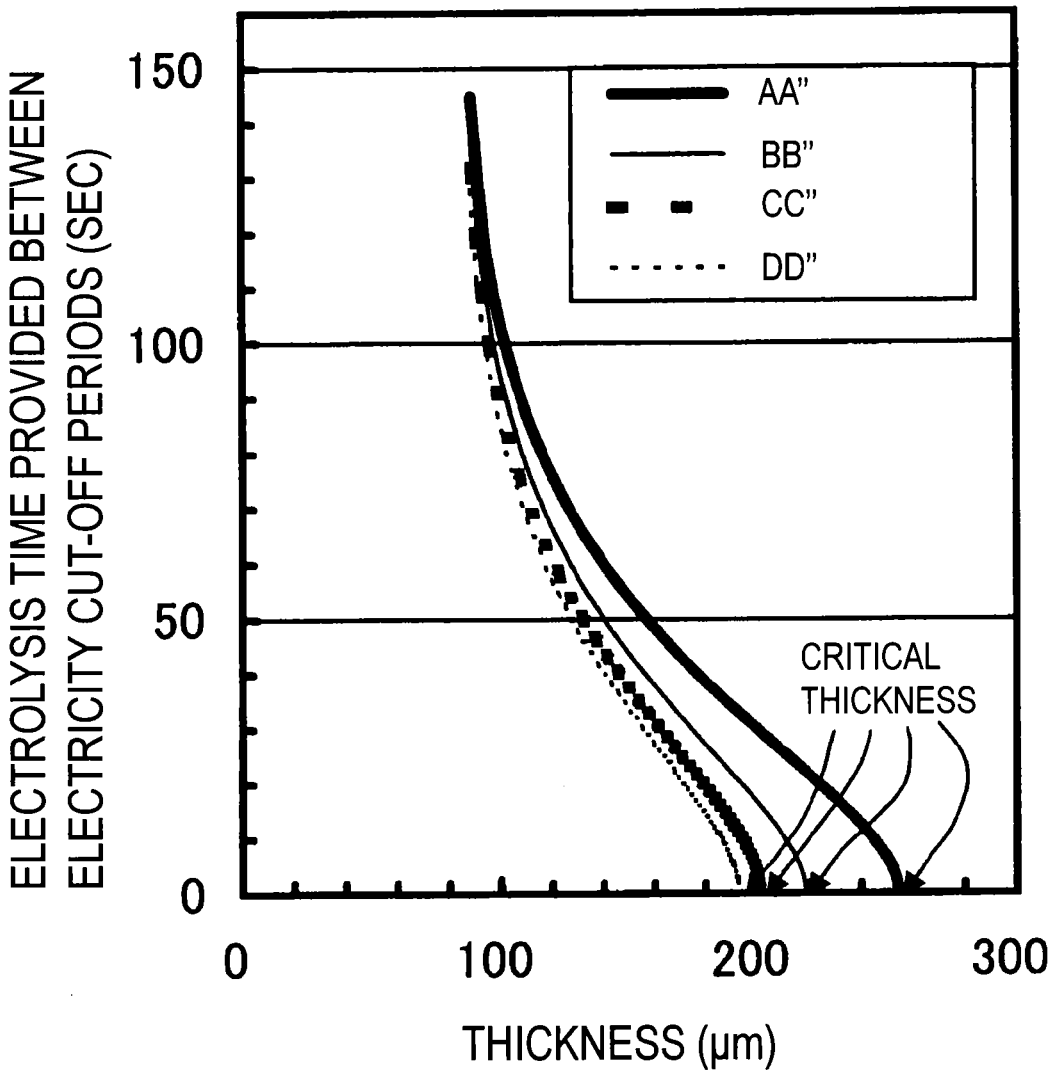
FIG. 4 is a graph showing the results obtained by converting the abscissa (x axis) of FIG. 3 from number of times of electricity cut-off to thickness.

FIG. 4 is a graph showing the results obtained by converting the abscissa (x axis) of FIG. 3 from number of times of electricity cut-off to thickness. At that time, the conversion is determined on the basis of {(thickness)=[200 (μm)/7,920 (sec)]×[3,366 (sec)+(total electrolysis time (sec) until the subject number of times of electricity cut-off after the electricity cut-off at the first time)]}. Here, the "7,920 seconds" means the total electrolysis time (sec) until the thickness becomes 200 μm and is a total sum of 3,366 seconds as a time until the voltage reaches the upper limit voltage and 4,554 seconds as a total electrolysis time after the number of times of electricity cut-off at which the thickness becomes 200 μm (Test Nos. 5 to 7), and the "200 (μm)/7,920 (sec)" corresponds to the film formation rate.

In addition, the "3,366 seconds" is a time until the voltage reaches the upper limit voltage (Table 1). The total electrolysis time (sec) until the subject number of times of electricity cut-off after the electricity cut-off at the first time is a time obtained by totalizing the "electrolysis time provided between electricity cut-off periods" at each time of numbers of electricity cut-off of the foregoing approximation expression "y=A−B·ln (x)" until the subject number of times of electricity cut-off.

Figure 5:
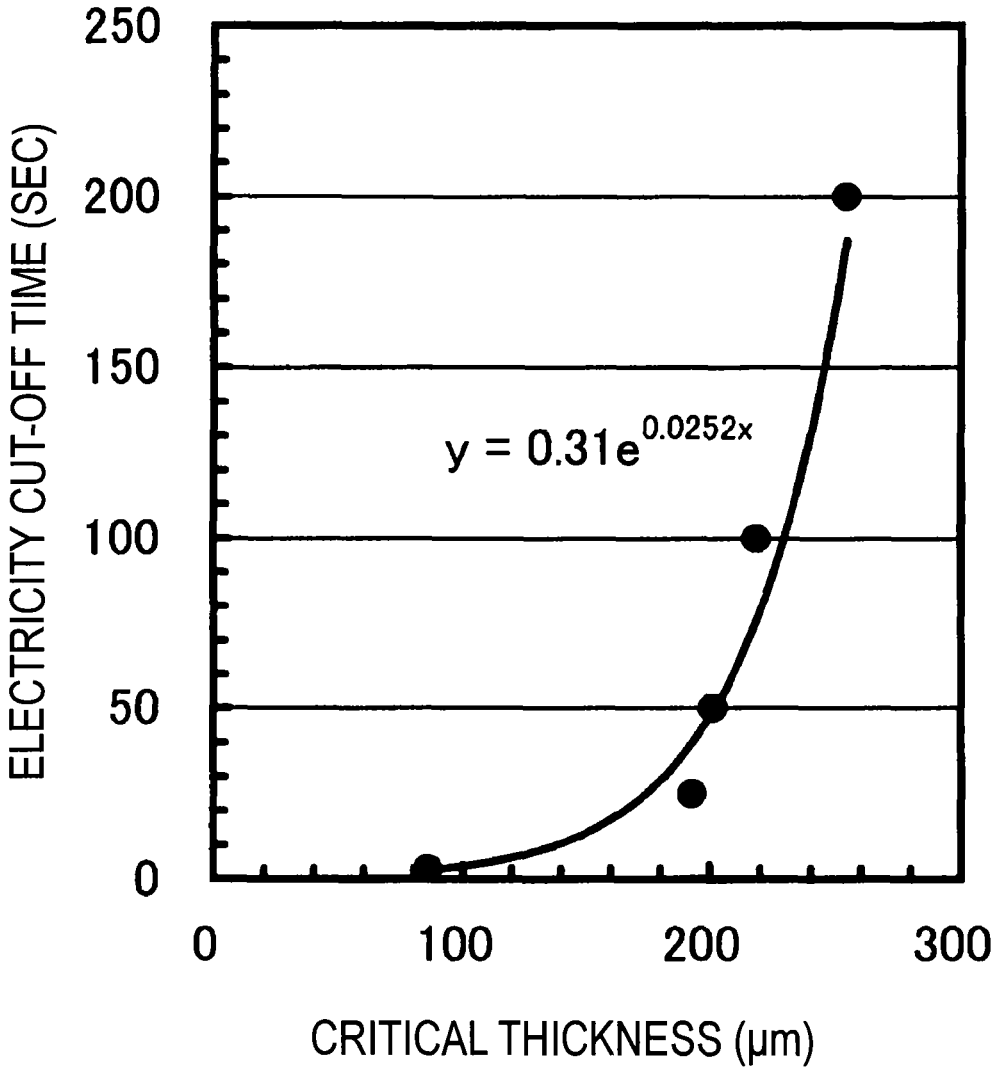
FIG. 5 is a graph plotting a relation between critical thickness and electricity cut-off time.

As for each electricity cut-off time, a thickness at which the "electrolysis time provided between electricity cut-off periods" becomes zero was determined from the results of FIG. 4. This thickness is called "critical thickness". FIG. 5 is a graph plotting a relation between the critical thickness and the electricity cut-off time, and when the electricity cut-off time is denoted as y, and the critical thickness is denoted as) x, the relation is expressed by [$y=0.31\times e^{(0.02.52x)}$] (e is base of natural logarithms). That is, when an electricity cut-off time equal to or longer than the "electricity cut-off time T1" as calculated by substituting a desired thickness into the critical thickness of the foregoing relational expression is taken, the "electrolysis time provided between electricity cut-off periods" does not become zero until reaching the desired thickness, and the desired thickness is obtained. In this Example, the thickness in the treatment until the voltage reaches the upper limit voltage in the constant current treatment is 85 μm, and the foregoing method for setting an electricity cut-off time is applied to the case where the thickness is 85 μm or more. However, in the case where the electricity cut-off time is short, it is supposed that reproducibility of the treatment is hardly obtained. Thus, it is recommended to apply setting of the electricity cut-off time in the thickness of 100 μm or more.

The results as shown above have been shown regarding the method for setting an electricity cut-off time in the method for forming an anode oxide film with a target thickness of 100 μm or more at an upper limit voltage of 80 V using a 6060 aluminum alloy as the aluminum base material in 150 g/L of a sulfuric acid solution at 0° C. under the condition of a current density of 4.0 A/dm$^2$. However, as for other treatment temperatures, treatment liquid compositions and the like, an electricity cut-off time can be similarly set according to a desired thickness by means of approximation from the treatment results of a thin film.

Next, the results shown in Table 2 are considered. Test No. 5 is concerned with an example in which the electricity cut-off time T1 is 50 seconds and is identical with Test No. 5 shown in Table 1. Test No. 8 is concerned with an example in which the electricity cut-off treatment is repeated under the treatment condition of the electricity cut-off time T1 of 50 seconds, and the electricity cut-off time at the time of electricity cut-off at the 70th time (about 170 μm in the thickness) is changed to 200 seconds (second electricity cut-off treatment). Similarly, Test No. 9 is concerned with an example in which the electricity cut-off treatment is repeated under the treatment condition of the electricity cut-off time T1 of 50 seconds, and the electricity cut-off time T2 at the time of electricity cut-off at the 100th time (about 1,850 μm in the thickness) is changed to 200 seconds; and Test No. 10 is concerned with an example in which the electricity cut-off treatment is repeated under the treatment condition of the electricity cut-off time T1 of 50 seconds, and the electricity cut-off time T2 at the time of electricity cut-off at the 70th time (about 170 μm in the thickness) and the 90th time (about 195 μm in the thickness) is changed to 200 seconds. In all of these examples, it is found that the treatment time becomes short as compared with that in Test No. 5 in which the electricity cut-off time was not replaced by the electricity cut-off time T2 of 200 seconds.

Figure 6:
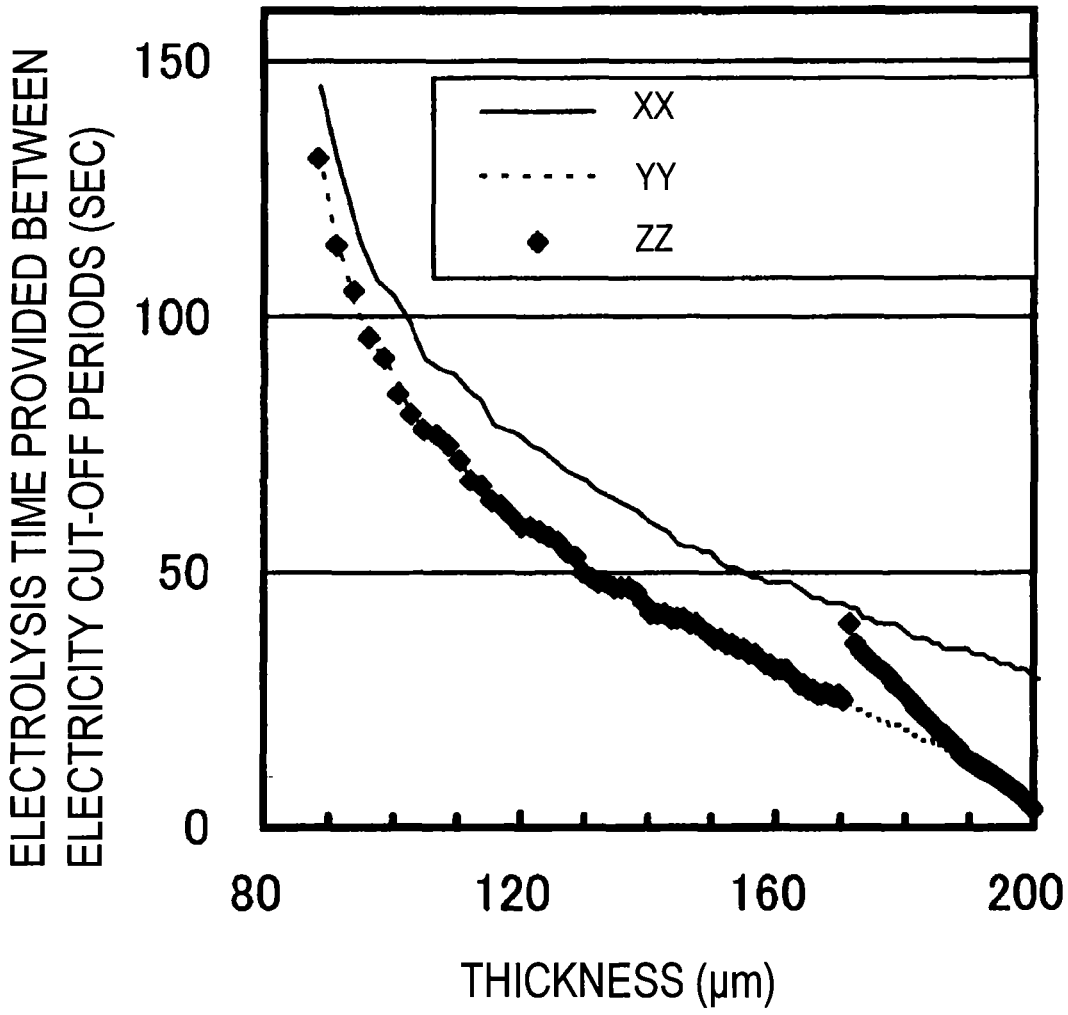
FIG. 6 is a graph showing a relation between "thickness during the treatment" and "electrolysis time provided between electricity cut-off periods" regarding Test No. 8.
Figure 7:
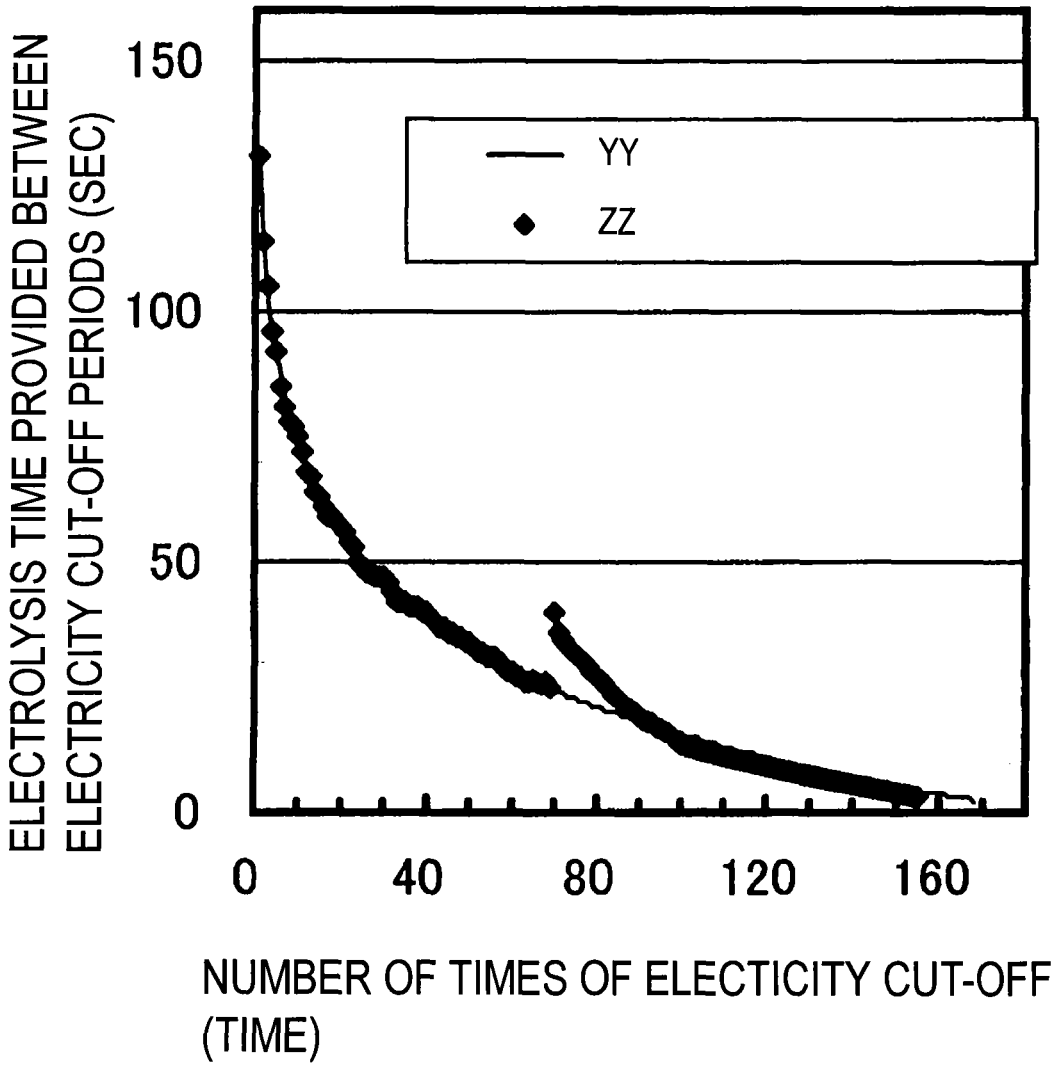
FIG. 7 is a graph showing a relation between "number of times of electricity cut-off" and "electrolysis time provided between electricity cut-off periods" regarding Test No. 8.

FIG. 6 is a graph showing a relation between "thickness during the treatment" and "electrolysis time provided between electricity cut-off periods" regarding the electricity cut-off treatment of Test No. 8. FIG. 7 is a graph showing a relation between "number of times of electricity cut-off" and "electrolysis time provided between electricity cut-off periods" regarding the electricity cut-off treatment of Test No. 8. In FIGS. 6 and 7, the results obtained in the example in which the electricity cut-off time is 200 seconds from the beginning (Test No. 7 in Table 1) and the example in which the electricity cut-off time is 50 seconds from the beginning (Test No. 5 in Table 1) are also shown. In addition, the thickness shown in FIG. 6 is determined from the foregoing relation (also same applied to FIGS. 8 to 11 as described later).

Figure 8:
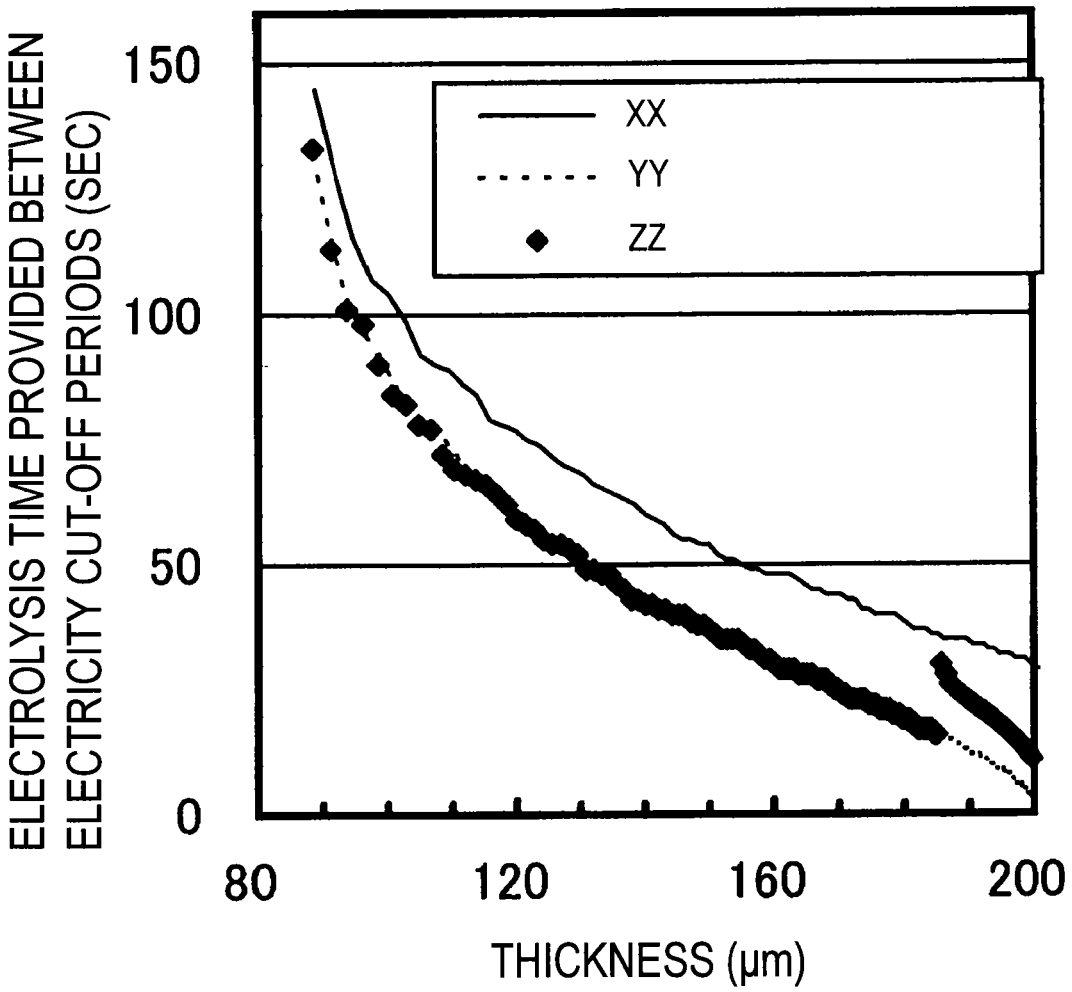
FIG. 8 is a graph showing a relation between "thickness during the treatment" and "electrolysis time provided between electricity cut-off periods" regarding Test No. 9.
Figure 9:
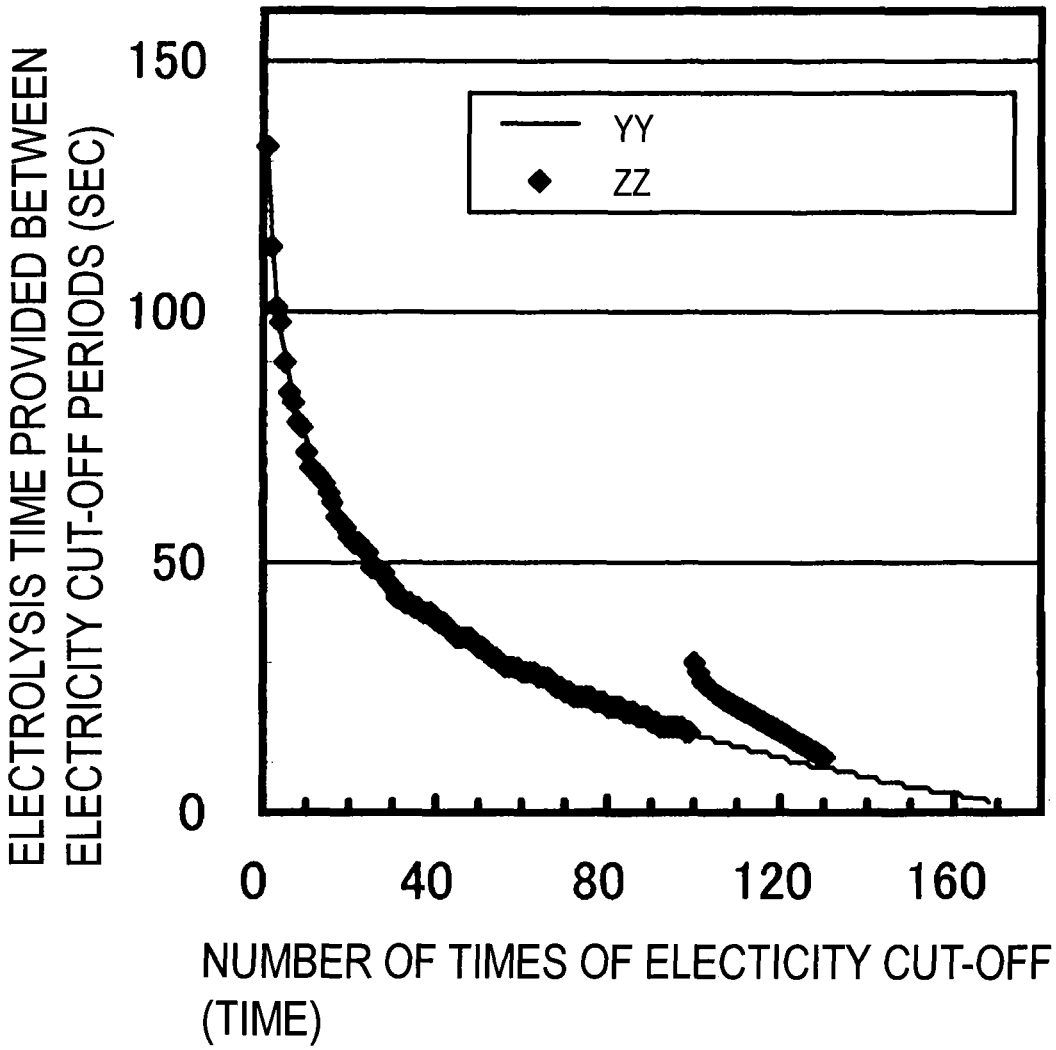
FIG. 9 is a graph showing a relation between "number of times of electricity cut-off" and "electrolysis time provided between electricity cut-off periods" regarding Test No. 9.
Figure 10:
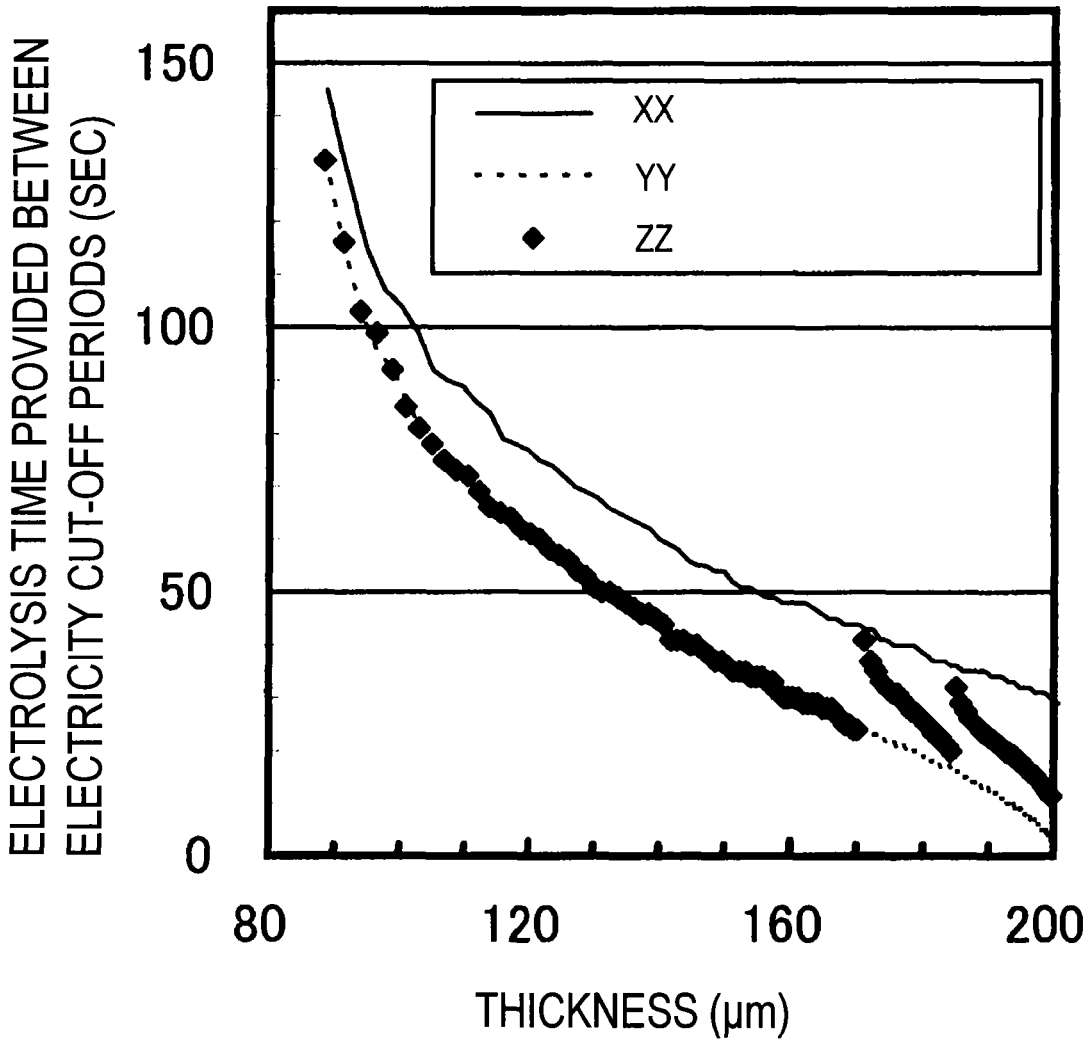
FIG. 10 is a graph showing a relation between "thickness during the treatment" and "electrolysis time provided between electricity cut-off periods" regarding Test No. 10.
Figure 11:
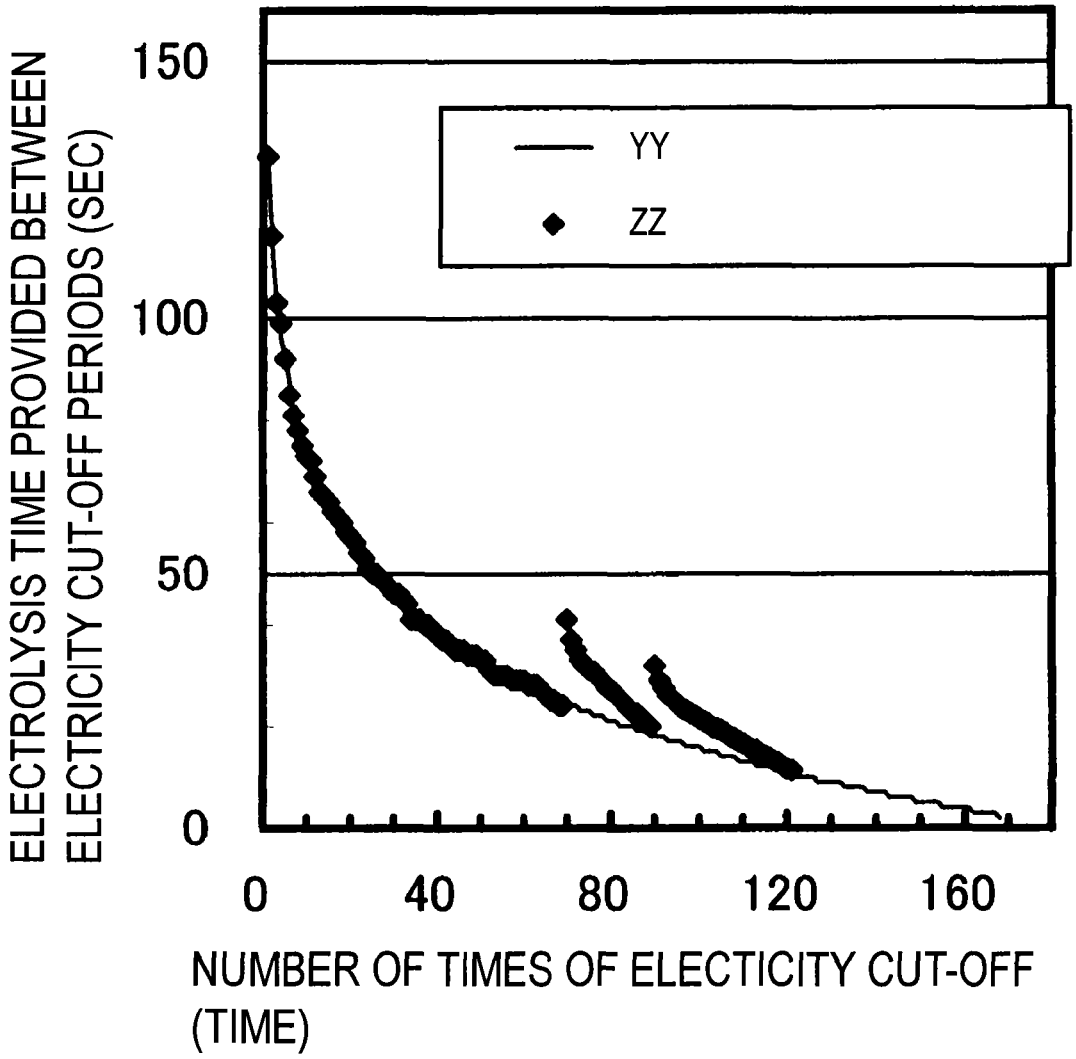
FIG. 11 is a graph showing a relation between "number of times of electricity cut-off" and "electrolysis time provided between electricity cut-off periods" regarding Test No. 10.

FIG. 8 is a graph showing a relation between "thickness during the treatment" and "electrolysis time provided between electricity cut-off periods" regarding the electricity cut-off treatment of Test No. 9. FIG. 9 is a graph showing a relation between "number of times of electricity cut-off" and "electrolysis time provided between electricity cut-off periods" regarding the electricity cut-off treatment of Test No. 9. FIG. 10 is a graph showing a relation between "thickness during the treatment" and "electrolysis time provided between electricity cut-off periods" regarding the electricity cut-off treatment of Test No. 10. FIG. 11 is a graph showing a relation between "number of times of electricity cut-off" and "electrolysis time provided between electricity cut-off periods" regarding the electricity cut-off treatment of Test No. 10.

When the electricity cut-off time T2 is set to 200 seconds at the 70th time of the number of times of electricity cut-off (Test No. 8), the voltage at the time of resuming the electrolysis after the electricity cut-off largely decreases, and the time until the voltage subsequently reaches the upper limit voltage (namely, the electrolysis time) becomes long (FIGS. 6 and 7). Thereafter, when the treatment is continued while setting the electricity cut-off time T1 to 50 seconds, the electrolysis time becomes gradually short, and finally, a relation of "thickness–electrolysis time" same as that when the treatment was conducted only at the electricity cut-off time T1 of 50 seconds is presented (FIG. 6).

As is clear from these results, it is found that as compared with the case where the treatment is conducted only at the electricity cut-off time T1 of 50 seconds, the treatment time becomes short by conducting the electricity cut-off treatment in which the electricity cut-off time T2 is prolonged on the way. Since the electrolysis time becomes short with an increase of the thickness, it is found that it is effective to change the electricity cut-off time to the long electricity cut-off time T2 at the final stage of the treatment; and that the case of Test No. 9 is shorter in the treatment time than the case of Test No. 8.

Furthermore, by conducting the change to the long electricity cut-off time T2 multiple times, there is the case where the treatment time can be more shortened (Test No. 10); however, the long electricity cut-off time T2 itself makes the total treatment time long, and therefore, the timing and number of times for properly adopting the long electricity cut-off time may be properly set while taking into consideration a balance between the long electricity cut-off time T2 and the effect for shortening the electrolysis time to be brought thereby.

From the foregoing knowledge, it is found that in the case of carrying out the second electricity cut-off treatment in which the electricity cut-off time is longer than the foregoing T1, the electricity cut-off time T2 of the second electricity cut-off treatment is preferably about at least 1.5 times and not more than about 5 times the foregoing T1.

In addition, as for the timing for conducting the second electricity cut-off treatment, it is found to be preferable to conduct the foregoing second electricity cut-off treatment after the first electricity cut-off treatment at the n-th time satisfying the foregoing expression (3).

Example 2

A test alloy plate was subjected to an anode oxidation treatment (including the electricity cut-off treatment) in the same manner as that in Example 1. In addition, the test alloy plate which had been subjected to the anode oxidation treatment was subjected to a hydration treatment and a heat treatment under various conditions. The conditions of the anode oxidation, the hydration treatment, and the heat treatment are shown in the following Tables 3 and 4 (Test Nos. 11 to 47). In addition, a hardness (Vickers hardness) of the anode oxide film surface in the test alloy plate which had been subjected to the foregoing treatments was measured. The target thickness D1 of the anode oxide film was set to 200 μm. Tables 3 and 4 also show the results of Test No. 6. In addition, Test No. 34A (Table 4) is concerned with an example in which a test alloy plate (base material) was subjected to a hydration treatment with pure water at 80° C. for 200 seconds (about 3 minutes) (this treatment is sometimes called "hydration pretreatment") before forming the anode oxide film (after cleaning up the base material surface by means of water washing).

TABLE 3

| | Film formation | | | | | | | |
|---|---|---|---|---|---|---|---|---|
| | Anode oxidation treatment | Temperature of treatment | Current density | Upper limit voltage V1 | Electricity cut-off time | Total treatment time | | Thickness |
| Test No. | liquid | liquid (° C.) | (A/dm$^2$) | (V) | (sec) | (sec) | (min) | (μm) |
| 11 | 150 g/L of sulfuric acid | 0 | 4 | 120 | Nil* | The aluminum base material was dissolved, and a good film was not obtained. | | |

TABLE 3-continued

| | | | | | | | |
|---|---|---|---|---|---|---|---|
| 12 | | | 115 | Nil* | 46200 | 770 | 200 |
| 13 | | | 115 | 100 | 16571 | 276 | 200 |
| 6 | | | 80 | | 19120 | 319 | 200 |
| 14 | | | 60 | | 20713 | 345 | 200 |
| 15 | | | 55 | | 22596 | 377 | 200 |

| | Hydration treatment | | | Heat treatment | | | |
|---|---|---|---|---|---|---|---|
| Test No. | Hydration treatment temperature (° C.) | −1.5 × (Treatment temperature) + 270 (min) | Hydration treatment time (min) | Heat treatment temperature (° C.) | −0.1 × [Treatment temperature (° C.)] + 71 (min) | Heat treatment time (min) | Vickers hardness (Hv) |
| 11 | The aluminum base material was dissolved, and a good film was not obtained. | | | | | | |
| 12 | No hydration treatment | | | No heat treatment | | | 390 |
| 13 | No hydration treatment | | | No heat treatment | | | 440 |
| 6 | No hydration treatment | | | No heat treatment | | | 410 |
| 14 | No hydration treatment | | | No heat treatment | | | 400 |
| 15 | No hydration treatment | | | No heat treatment | | | 380 |

*After the voltage reached the upper limit voltage, the constant voltage treatment was conducted at the upper limit voltage.

TABLE 4

| | | Film formation | | | | | | | |
|---|---|---|---|---|---|---|---|---|---|
| Test No. | Hydration pretreatment | Anode oxidation treatment liquid | Temperature of treatment liquid (° C.) | Current density ($A/dm^2$) | Upper limit voltage V1 (V) | Electricity cut-off time T1 (sec) | Total treatment time (sec) | Total treatment time (min) | Thickness (μm) |
| 6 | No | 150 g/L of sulfuric acid | 0 | 4 | 80 | 100 | 19120 | 319 | 200 |
| 16 | | | | | | | | | |
| 17 | | | | | | | | | |
| 18 | | | | | | | | | |
| 19 | | | | | | | | | |
| 20 | | | | | | | | | |
| 21 | | | | | | | | | |
| 22 | | | | | | | | | |
| 23 | | | | | | | | | |
| 24 | | | | | | | | | |
| 25 | | | | | | | | | |
| 26 | | | | | | | | | |
| 27 | | | | | | | | | |
| 28 | | | | | | | | | |
| 29 | | | | | | | | | |
| 30 | | | | | | | | | |
| 31 | | | | | | | | | |
| 32 | | | | | | | | | |

| | Hydration treatment | | | Heat treatment | | | |
|---|---|---|---|---|---|---|---|
| Test No. | Hydration treatment temperature (° C.) | −1.5 × (Treatment temperature) + 270 (min) | Hydration treatment time (min) | Heat treatment temperature (° C.) | −0.1 × [Treatment temperature (° C.)] + 71 | Heat treatment time (min) | Vickers hardness (Hv) |
| 6 | No hydration treatment | | | | No heat treatment | | 410 |
| 16 | 100 | 120 | 30 | | No heat treatment | | 405 |
| 17 | | | 60 | | No heat treatment | | 400 |
| 18 | | | 90 | | No heat treatment | | 390 |
| 19 | | | 100 | | No heat treatment | | 400 |
| 20 | | | 110 | | No heat treatment | | 405 |
| 21 | | | 120 | | No heat treatment | | 430 |
| 22 | | | 180 | | No heat treatment | | 450 |
| 23 | | | 240 | | No heat treatment | | 460 |
| 24 | | | | 115 | 59.5 | 240 | 460 |
| 25 | | | | 120 | 59.0 | 55 | 460 |
| 26 | | | | | 59.0 | 60 | 490 |
| 27 | | | | | 59.0 | 120 | 540 |
| 28 | | | | | 59.0 | 240 | 550 |
| 29 | | | | | 59.0 | 300 | 550 |
| 30 | | | | 450 | 26.0 | 25 | 470 |

TABLE 4-continued

| | | | | | | | | | |
|---|---|---|---|---|---|---|---|---|---|
| 31 | | | | | | 26.0 | 28 | | 520 |
| 32 | | | | | | 26.0 | 45 | | 580 |

| | | Film formation | | | | | | | |
|---|---|---|---|---|---|---|---|---|---|
| Test No. | Hydration pretreatment | Anode oxidation treatment liquid | Temperature of treatment liquid (° C.) | Current density ($A/dm^2$) | Upper limit voltage V1 (V) | Electricity cut-off time T1 (sec) | Total treatment time (sec) | Total treatment time (min) | Thickness (μm) |
| 33 | No | 150 g/L of sulfuric acid | 0 | 4 | 80 | 100 | 19120 | 319 | 200 |
| 34 | | | | | | | | | |
| 34A | Yes | | | | | | 19320 | 322 | |
| 35 | No | | | | | | 19120 | 319 | |
| 36 | | | | | | | | | |
| 37 | | | | | | | | | |
| 38 | | | | | | | | | |
| 39 | | | | | | | | | |
| 40 | | | | | | | | | |
| 41 | | | | | | | | | |
| 42 | | | | | | | | | |
| 43 | | | | | | | | | |
| 44 | | | | | | | | | |
| 45 | | | | | | | | | |
| 46 | | | | | | | | | |
| 47 | | | | | | | | | |

| | Hydration treatment | | | Heat treatment | | | |
|---|---|---|---|---|---|---|---|
| Test No. | Hydration treatment temperature (° C.) | −1.5 × (Treatment temperature) + 270 (min) | Hydration treatment time (min) | Heat treatment temperature (° C.) | −0.1 × [Treatment temperature (° C.)] + 71 | Heat treatment time (min) | Vickers hardness (Hv) |
| 33 | 100 | 120 | 240 | 450 | 26.0 | 60 | 620 |
| 34 | | | | | 26.0 | 80 | 630 |
| 34A | | | | | | | 640 |
| 35 | 80 | 150 | 30 | | No heat treatment | | 410 |
| 36 | | | 60 | | No heat treatment | | 390 |
| 37 | | | 120 | | No heat treatment | | 395 |
| 38 | | | 140 | | No heat treatment | | 400 |
| 39 | | | 150 | | No heat treatment | | 425 |
| 40 | | | 180 | | No heat treatment | | 440 |
| 41 | | | 240 | | No heat treatment | | 450 |
| 42 | 70 | 165 | 30 | | No heat treatment | | 410 |
| 43 | | | 60 | | No heat treatment | | 405 |
| 44 | | | 90 | | No heat treatment | | 400 |
| 45 | | | 120 | | No heat treatment | | 400 |
| 46 | | | 180 | | No heat treatment | | 390 |
| 47 | | | 240 | | No heat treatment | | 390 |

Test No. 11 in Table 3 is concerned with an example in which the anode oxide film was formed at a current density of 4.0 $A/dm^2$ without conducting the electricity cut-off treatment, the upper limit voltage was set to 120 V, and at the stage where the voltage reached 120 V, the treatment was switched to the constant voltage treatment at 120V. However, the aluminum base material was dissolved, and a good anode oxide film could not be formed.

Test No. 12 in Table 3 is concerned with an example in which the current density was set to 4.0 $A/dm^2$, the upper limit voltage was set to 115 V, and at the stage where the voltage reached 115 V, the treatment was switched to the constant voltage treatment at 115 V. In this test, after switching to the constant voltage treatment, the current density decreased, and it took 770 minutes until the thickness reached 200 μm. In addition, the hardness of the film was Hv 390.

Test Nos. 13, 6, 14, and 15 in Table 3 are concerned with examples in which the current density was set to 4.0 $A/dm^2$, the upper limit voltage was set to 115V, 80V, 60V, and 55V, respectively, and after reaching the upper limit voltage, the electricity cut-off treatment of 100 seconds was conducted. The treatment time until the thickness reached 200 μm is largely shortened as compared with that in Test No. 12. Furthermore, the hardness of each of the films of Test Nos. 13, 6, and 14 is high as compared with that of Test No. 12. On the other hand, the hardness of the film of Test No. 15 in which the upper limit voltage was set low as compared with Test Nos. 13, 6, and 14 is low as compared with that of Test No. 12. According to this fact, in the case of paying attention to the hardness, it is found to be preferable to set the high upper limit voltage V1 within the range of a voltage lower than the voltage ($V_{min}$) at which the aluminum base material starts to be dissolved, while taking into account a risk of dissolution.

The larger the solid volume fraction of the porous film is, the harder the hardness of the film is. The solid volume fraction of the film becomes small due to chemical dissolution of the film during the treatment, and the chemical dissolution of the film correlates with the treatment time. On the other hand, the larger the electrolysis voltage is, the larger the volume fraction is. Therefore, it may be considered that the hardness of the film is determined according to the balance thereamong.

Table 4 is concerned with an example in which after forming an anode oxide film, the hydration treatment or the heat treatment was applied under the prescribed condition. It is found that the hardness of the anode oxide film can be more increased by applying such a treatment (only the hydration treatment, or the hydration treatment and the heat treatment, or if desired, the hydration pretreatment before the anode oxidation treatment) under an appropriate condition.

While the invention has been described in detail and with reference to specific embodiments thereof, it will be apparent to one skilled in the art that various changes and modifications can be made therein without departing from the spirit and scope thereof.

This application is based on Japanese Patent Application No. 2010-039126 filed on Feb. 24, 2010 and Japanese Patent Application No. 2011-001323 filed on Jan. 6, 2011, and the entire subject matters of which are incorporated herein by reference.

Industrial Applicability

According to the present invention, when an anode oxide film is formed by allowing a prescribed current to pass through an aluminum base material selected from aluminum and aluminum alloys, by adopting a constitution of repeating a first electricity cut-off treatment multiple times, in which when the voltage reaches a prescribed voltage during the formation of the film, the passage of electricity is once cut off, this cut-off of the passage of electricity is continued for a period equal to or longer than an electricity cut-off time T1, and the passage of electricity is then resumed, a thick anode oxide film can be formed with good productivity within a short time without using special equipment. Members having the anode oxide film formed on the base material in this way are useful as a material of vacuum chambers used for plasma treatment apparatus of semiconductor manufacturing equipment, and the like.

The invention claimed is:

1. A method for forming an anode oxide film on an aluminum base material, the method comprising passing a prescribed current $A_0$ through the aluminum base material which is aluminum or an aluminum alloy, repeating a first electricity cut-off treatment multiple times, in which when a voltage reaches a prescribed voltage V1 during formation of the film, passage of electricity is once cut off, remains cut off for a period equal to or longer than an electricity cut-off time T1, and is then resumed, and conducting a second electricity cut-off treatment in which an electricity cut-off time is longer than the electricity cut-off time T1, wherein the prescribed voltage V1 satisfies expression (1a);

the electricity cut-off time T1 satisfies expression (1b); and said conducting occurs after the first electricity cut-off treatment at the n-th time which satisfies expression (3):

$$V1<V_{min} \quad (1a)$$

$$T1_{im}\leq T1 \quad (1b)$$

$$0.5\leq T_{min(n-1)}/T_{int(1)}\leq 0.9 \quad (3)$$

where $V_{min}$ represents a minimum value of a voltage at which the aluminum base material starts to be dissolved when an anode oxidation treatment is conducted with the prescribed current $A_0$ without conducting an electricity cut-off treatment;

$T1_{im}$ represents a minimum value of an electricity cut-off time necessary for a voltage at the time of resuming the passage of electricity to become lower than V1;

$T_{int(1)}$ represents a time during which the passage of electricity is resumed starting from the completion of the first electricity cut-off treatment at the first time and ending at the start of the first electricity cut-off treatment at the second time; and $T_{min(n-1)}$ represents a time during which the passage of electricity is resumed starting from the completion of the first electricity cut-off treatment at the (n−1)-th time and ending at the start of the first electricity cut-off treatment at the n-th time.

2. The method according to claim 1, wherein the prescribed voltage V1 satisfies expression (2a); and the electricity cut-off time T1 satisfies expression (2b):

$$0.5\times V_{min}<V1<V_{min} \quad (2a)$$

$$T_{min}\leq T1\leq 1.2\times T_{min} \quad (2b)$$

$T_{min}$ represents a minimum value of an electricity cut-off time necessary for achieving a target thickness D1 of the anode oxide film.

3. The method according to claim 2, wherein the target thickness D1 is 100 μm or more, and the $V_{min}$ is from 100 to 150 V.

4. The method according to claim 3, wherein a 6000 series aluminum alloy is used as the aluminum base material and sulfuric acid is used as an anode oxidation treatment liquid to achieve the $V_{min}$.

5. The method according to claim 1, wherein an electricity cut-off time T2 of the second electricity cut-off treatment is at least 1.5 times and not more than 5 times the electricity cut-off time T1.

6. The method according to claim 1, wherein said conducting occurs multiple times.

7. The method according to claim 1, wherein the prescribed voltage V1 is from 60 to 115 V.

8. A method for increasing hardness of an anode film, the method comprising forming the anode oxide film by the method according to claim 1, subsequently dipping the anode oxide film in pure water at a temperature of from 80 to 100° C. under a condition satisfying the following relation in a hydration treatment:

treatment time(min)≥−1.5 ×[treatment temperature (° C.)]+270.

9. The method according to claim 8, further comprising after said dipping, heating the anode oxide film in a heat treatment at a treatment temperature of from 120 to 450° C. under a condition satisfying the following relation:

treatment time(min)≥−0.1×[treatment temperature(° C.)]+71.

10. The method according to claim 1, further comprising:

subjecting the aluminum base material to a hydration treatment in pure water before the formation of the anode oxide film.

* * * * *